US007090002B2

(12) United States Patent
Connors et al.

(10) Patent No.: US 7,090,002 B2
(45) **Date of Patent: *Aug. 15, 2006**

(54) DEFORMABLE END CAP FOR HEAT PIPE

(75) Inventors: Matthew Connors, Lancaster, PA (US); Arthur H. Good, Paradise, PA (US)

(73) Assignee: Thermal Corp., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/983,429

(22) Filed: Nov. 8, 2004

(65) Prior Publication Data

US 2005/0082039 A1 Apr. 21, 2005

Related U.S. Application Data

(63) Continuation of application No. 10/364,435, filed on Feb. 10, 2003, now Pat. No. 6,907,918.

(60) Provisional application No. 60/356,625, filed on Feb. 13, 2002.

(51) Int. Cl.
*F28D 15/00* (2006.01)
*H05K 7/20* (2006.01)

(52) U.S. Cl. ..... 165/104.21; 165/46; 165/81; 165/104.26

(58) Field of Classification Search ..... 165/104.21, 165/104.26, 104.32, 46, 104.27, 104.31, 165/81, 82, 177; 29/890.032; 220/201, 220/213, 608, 609, 720, 729; 361/700; 257/714–715
See application file for complete search history.

(56) References Cited

U.S. PATENT DOCUMENTS 2,168,734 A 8/1939 Freeman
2,942,625 A 6/1960 Costanzo
3,163,314 A * 12/1964 Mauser ..... 220/305
3,517,730 A * 6/1970 Wyatt ..... 165/272
3,680,189 A * 8/1972 Noren ..... 29/890.032
3,797,086 A * 3/1974 Asselman ..... 29/890.032
4,046,168 A 9/1977 Milne
4,106,171 A * 8/1978 Basiulis ..... 29/890.032
4,760,878 A * 8/1988 Fukui et al. ..... 165/104.27
4,773,476 A * 9/1988 Baehrle et al. ..... 165/104.27
4,776,389 A 10/1988 Murphy et al.
5,029,389 A 7/1991 Tanzer
5,226,580 A 7/1993 Hartle et al.
5,241,950 A 9/1993 Mahdjuri-Sabet
5,379,830 A 1/1995 Itoh
5,704,415 A 1/1998 Suzuki et al.
5,737,840 A 4/1998 Akachi
5,895,868 A 4/1999 Giammaruti et al.

* cited by examiner

*Primary Examiner*—Tho Duong
(74) *Attorney, Agent, or Firm*—Duane Morris LLP

(57) ABSTRACT

A heat pipe is provided having a vessel with a closed first end, a second end, and a wick on an inner surface that defines a passageway. A convex wall is positioned at the second end so as to block the passageway. The convex wall is deformable so as to move from a first position wherein a portion of the wall is convex to a second position wherein the portion of the wall is concave. The convex wall may include at least one stress concentrator so that upon an application of a force to the convex wall, the stress concentrator causes the convex wall to buckle. A method for forming the above-described heat pipe is also provided.

12 Claims, 5 Drawing Sheets

DEFORMABLE END CAP FOR HEAT PIPE

CROSS-REFERENCE TO RELATED APPLICATIONS

This application is a continuation application of copending U.S. application Ser. No. 10/364,435, filed on Feb. 10, 2003, now U.S. Pat. No. 6,907,918 which itself claimed the benefit of Provisional Patent Application Ser. No. 60/356,625, filed Feb. 13, 2002.

FIELD OF THE INVENTION

The present invention generally relates to the manufacture of heat pipes, and more particularly to a method and apparatus for closing the end of a heat pipe after it has been filled with a working fluid.

BACKGROUND OF THE INVENTION

As the density and power of electronic components have increased, the problem of excessive heat generation has become a significant concern to industry. Heat pipes have been found to provide superior thermal transfer characteristics for cooling electronic circuits.

In the prior art, a heat pipe often comprises a closed vessel or chamber whose inner surfaces are lined with a porous capillary wick that is saturated with a working fluid. The heat pipe has an evaporator section that absorbs heat and a condenser section where the heat is released to a heat sink in contact with that section of the heat pipe. In operation, heat absorbed by the evaporator section causes liquid to evaporate from the wick. The resultant vapor is transferred within the vessel to the condenser section of the heat pipe where it condenses releasing the heat of vaporization to a heat sink. The capillary action of the wick pumps the condensed liquid back to the evaporator section for re-evaporation. The process will continue as long as working fluid is contained within the heat pipe.

Sometimes, the working fluid in the heat pipe chamber is lost due to a breach of the heat pipe's wall. Such a breach often occurs at the point where the working fluid was introduced into the heat pipe. The ability to reliably and effectively seal heat pipes has been sought by the industry for many years, because if the fluid within the heat pipe is lost, the equipment cooled by the heat pipe could be subject to significant heat damage. Several means of sealing heat pipes have evolved over the last couple of years.

In one conventional arrangement, a heat pipe includes a hollow tube with end caps inserted into each end of the vessel. One end cap has a hole therethrough with a copper pinch-off tube brazed to the hole. The heat pipe is purged and filled with the proper working fluid using the copper tube. To seal the heat pipe, the copper tube is pinched shut using a roller pinch off tool or the like. See, for example, Dunn & Reay, Heat Pipes 154 (3rd Ed. 1982). However, the rollers of the pinch off tool get close to the braze and may crack the braze during pinch off. Additionally, after being sealed the fragile copper tube protrudes outwardly a short distance from the end cap, and therefore is very susceptible to breakage. In order to adequately protect this protruding copper tube, a cover must be placed over the end cap and copper tube. The end cap cover and copper tube disadvantageously consume a large portion of the condenser section at the end of the heat pipe. Both reliability and efficiency of the heat pipe are limited by this technique.

In an attempt to improve upon this design, the copper tube has been attached directly to the side of the heat pipe vessel instead of to the end cap. In this prior art arrangement, a copper tube is welded into a hole within the side of the heat pipe vessel, and the heat pipe tube chamber is purged and filled with working fluid using this copper vessel. After filling the heat pipe with fluid, the copper tube is pinched shut to seal the vessel. As with the above-described process, the weld can be cracked during pinch off. Furthermore, this sealing technique is disadvantageous in that a portion of the copper tube extends outwardly from the side of the heat pipe. In this arrangement, the fragile copper tube has no cover and is very susceptible to breakage. Additionally, the placement of the copper pinch-off tube on the side of the heat pipe vessel hampers expulsion of non-condensable gases during purging. Furthermore, because the copper tube protrudes outwardly from the side of the heat pipe, heat pipes formed by this technique cannot be placed adjacent to each other.

Consequently, there is a need in the art for an improved heat pipe which is economically accomplished, and provides a strong and reliable seal.

SUMMARY OF THE INVENTION

The present invention provides a heat pipe comprising a vessel having a first end, a second end, and an inner surface that defines a passageway wherein the first end is closed. A wick is disposed on a portion of the inner surface. A convex wall is positioned at the second end so as to block the passageway. The convex wall is deformable so as to move from a first position wherein a portion of the wall is convex to a second position wherein the portion of the wall is concave.

In another embodiment, a heat pipe is provided that comprises a vessel having a first end, a second end, and an inner surface defining a passageway, wherein the first end is closed. A wick is disposed on at least a portion of the inner surface of the vessel. A convex wall is positioned at the second end of the vessel so as to block the passageway. The convex wall includes at least one stress concentrator so that upon an application of a force to the convex wall, the stress concentrator causes the convex wall to buckle and thereby move from a first position wherein a portion of the wall is convex to a second position wherein the portion of the wall is concave.

A method for forming a heat pipe is also provided comprising coating the interior surface of the vessel with a wicking material and partially saturating the wick with a working fluid. The vessel is then partially evacuated. A portion of the vessel is pinched-off so as to seal the vessel. Then, the pinched-off portion of the vessel is pressed so as to move it from a first position wherein the portion is convex to a second position wherein the portion is concave.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein.

DETAILED DESCRIPTION OF THE PREFERRED EMBODIMENT

Figure 1:
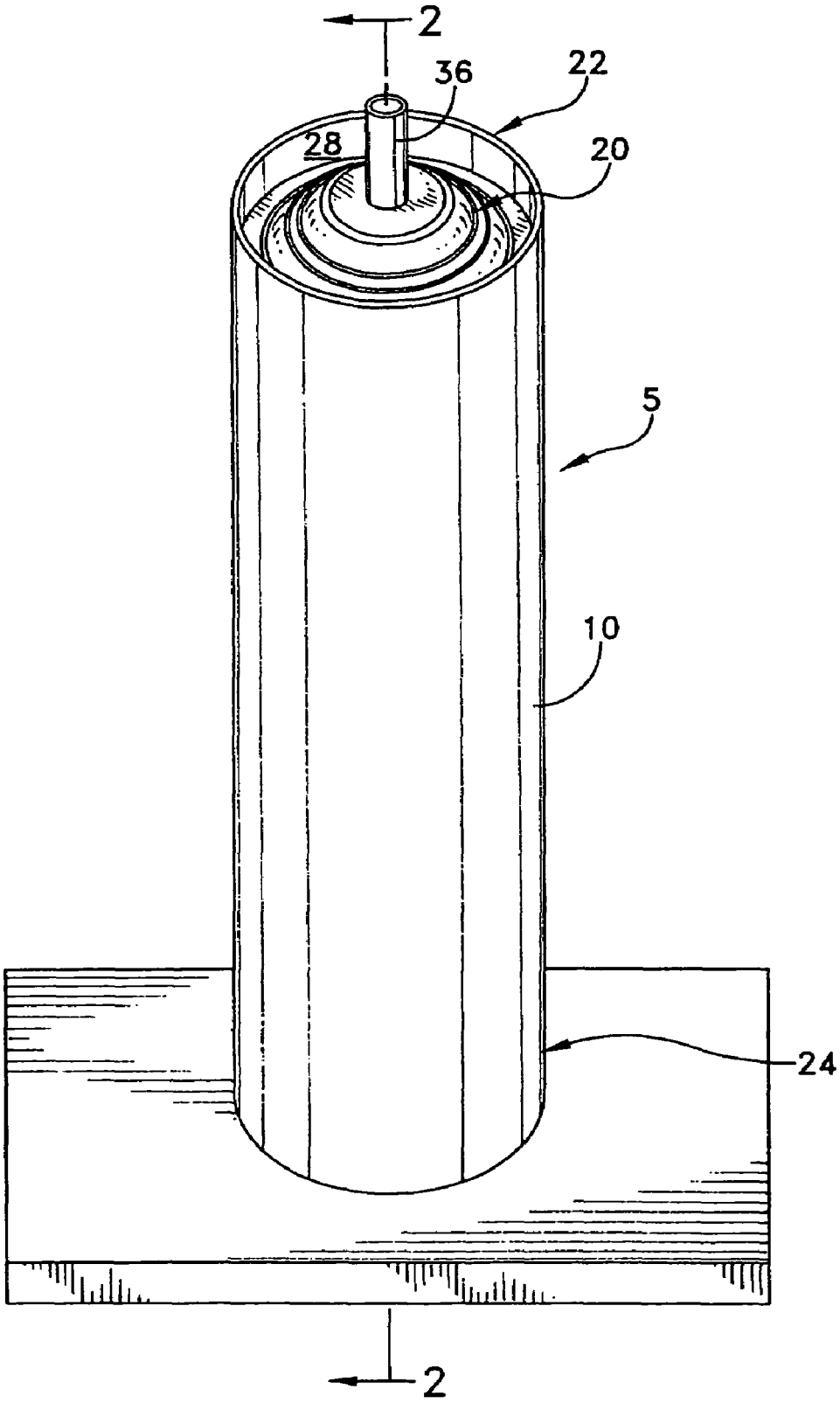
FIG. 1 is a perspective view of a heat pipe formed in accordance with the present invention.

This description of preferred embodiments is intended to be read in connection with the accompanying drawings, which are to be considered part of the entire written description of this invention. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

Figure 2:
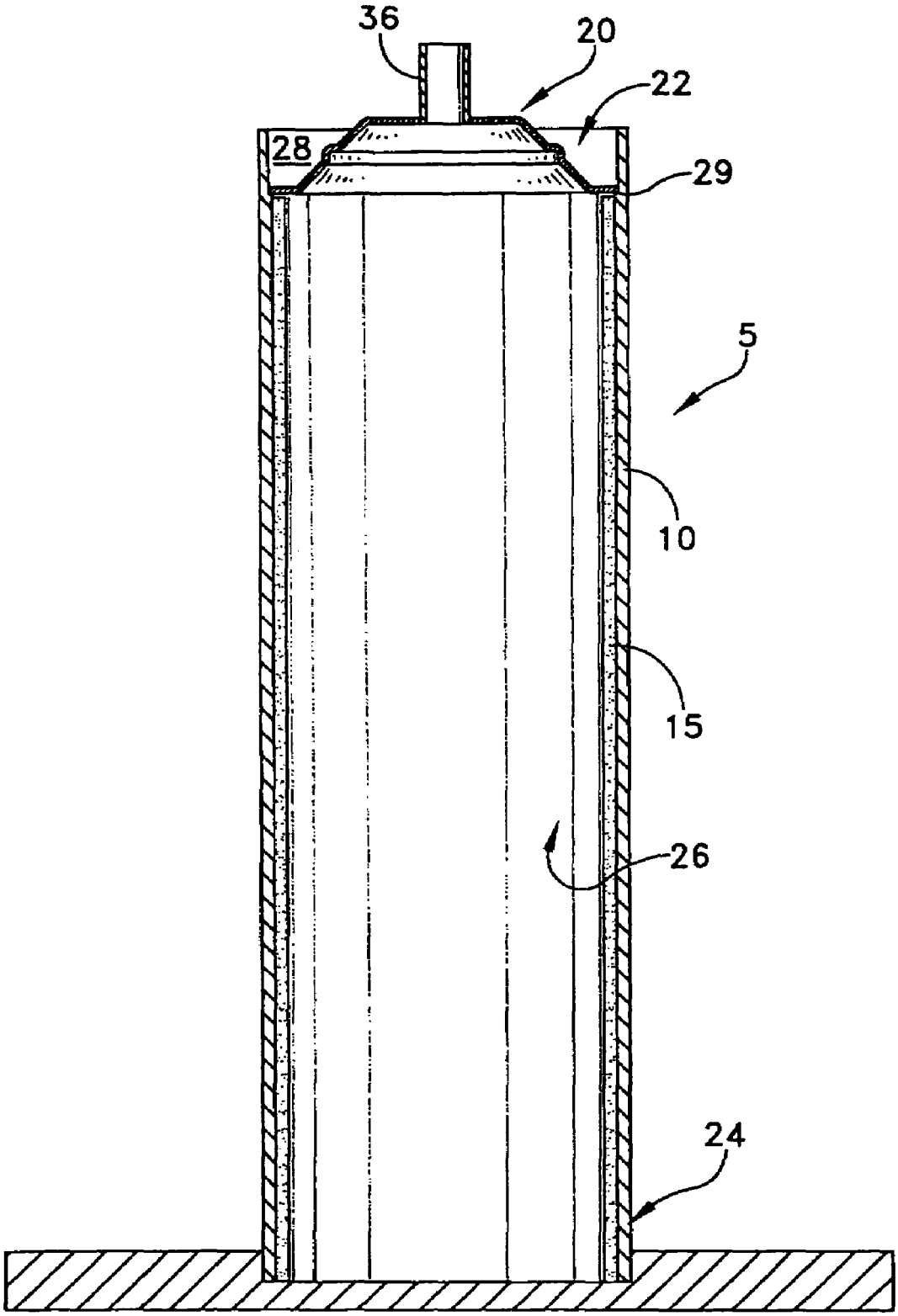
FIG. 2 is a cross-sectional view of the heat pipe shown in FIG. 1, as taken along lines 2—2 in FIG. 1.
Figure 3:
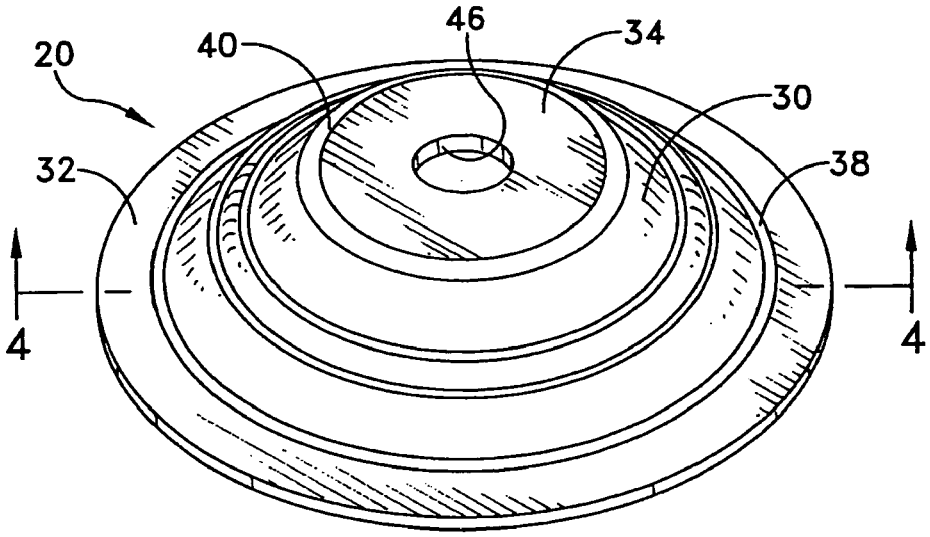
FIG. 3 is a perspective view of a deformable end cap formed in accordance with the present invention.
Figure 4:
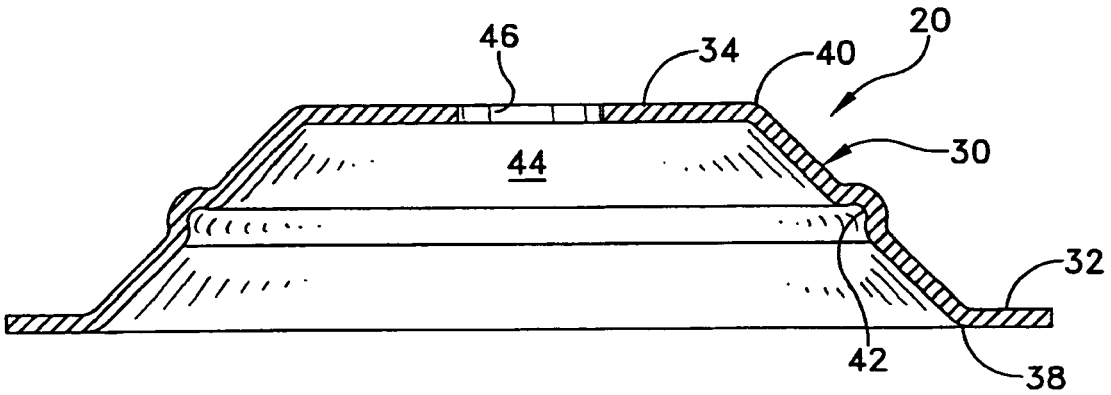
FIG. 4 is a cross-sectional view of the deformable end cap shown in FIG. 3, as taken along lines 4—4 in FIG. 3.
Figure 5:
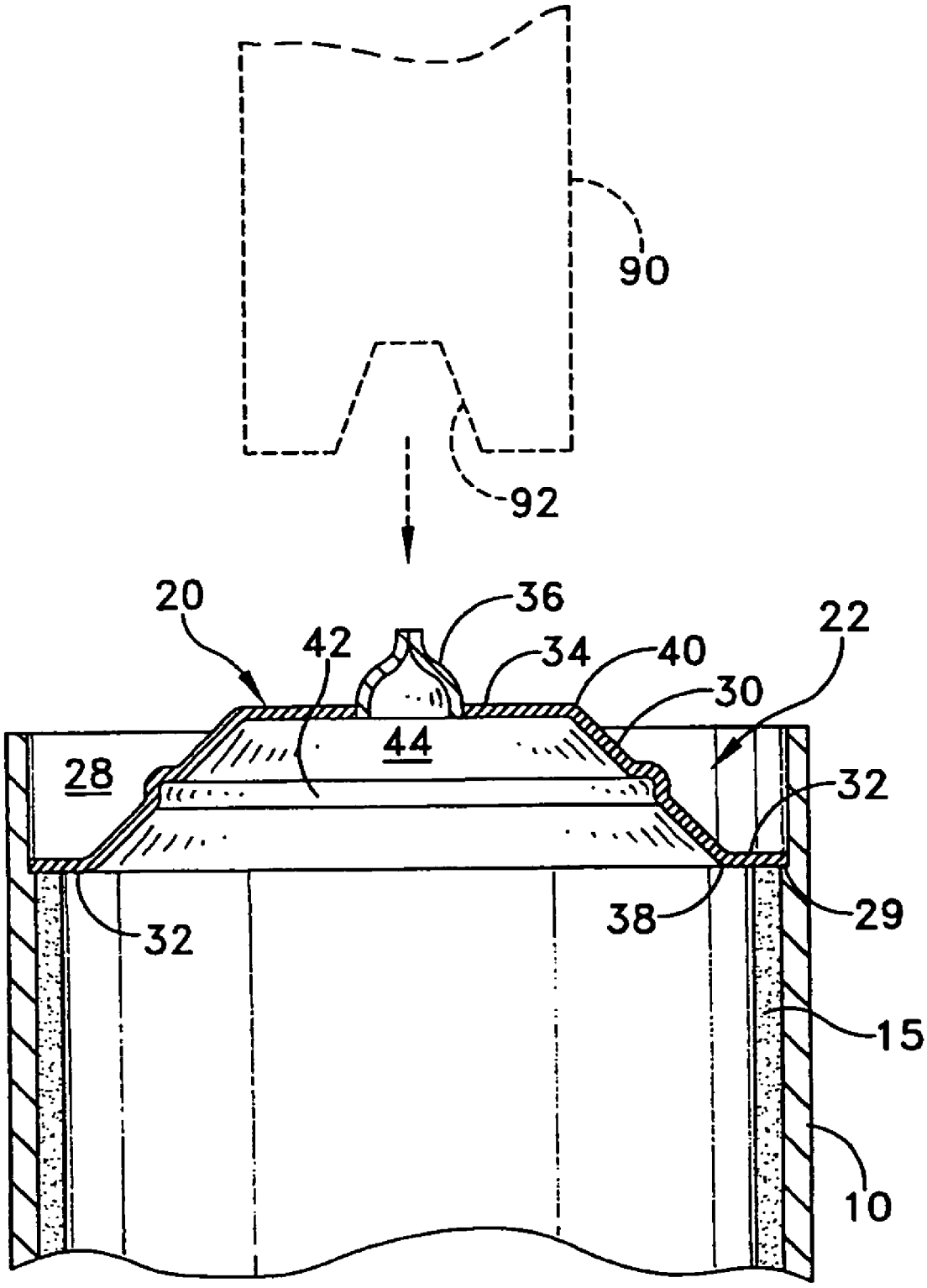
FIG. 5 a cross-sectional view of the heat pipe shown in FIG. 2, and including a forming tool shown in phantom.

Referring to FIGS. 1 and 2, a heat pipe 5 formed in accordance with the present invention comprises of a vessel 10, a wick 15, an end cap 20 and a working fluid (not shown). More particularly, vessel 10 includes a temporarily open end 22, a closed end 24, and a central passageway 26 that is defined by the interior surface 28 of vessel 10. A relatively long blind cylinder or tube that is formed from a thermally conductive material, e.g., copper or its alloys, monel, or the like, is often preferred for vessel 10. Of course, other shapes of vessel 10 may be used with equal effect, e.g., a plate having a longitudinally and transversely extending interior space. An annular shoulder 29 is formed in interior surface 28, adjacent to, but spaced away from open end 22. Central passageway 26 defines a vapor space within vessel 10.

Wick 15 is disposed upon interior surface 28 of vessel 10 below annular shoulder 29, and may comprise adjacent layers of screening or a sintered powder structure with interstices between the particles of powder. In one embodiment, wick 15 may comprise sintered copper powder, sintered aluminum-silicon-carbide (AlSiC) or copper-silicon-carbide (CuSiC) having an average thickness of about 0.1 mm to 1.0 mm. The working fluid (not shown) may comprise any of the well known two-phase vaporizable liquids, e.g., water alcohol, freon, etc.

Referring to FIGS. 1–4, end cap 20 is sized and shaped to be permanently lodged within open end 22, and comprises a deformable-wall 30, a flange 32, a face plate 34, and a fill tube 36. More particularly, deformable-wall 30 comprises a convex, outwardly curved shape having a bottom edge 38, a top edge 40, and a centrally disposed annular groove 42 on an inner surface 44. Often, deformable-wall 30 comprises a frusto-conical shape. Flange 32 projects radially outwardly from bottom edge 38, and face plate 34 projects radially inwardly from top edge 40. A central through-bore 46 is defined in face plate 34 that is sized and shaped to sealingly receive fill-vessel 36. Annular groove 42 acts as a stress concentrator when force is applied to face plate 34. Of course, other defects may be defined in deformable-wall 30 to also act as stress concentrators, e.g., radial grooves, periodic grooves, cuts, etc. Although less preferred, deformable-wall 30 may not include a stress concentrator and still function in accordance with the invention. This embodiment will be less reliable than the embodiments comprising a stress concentrator.

A heat pipe 5 is formed in accordance with the present invention from a vessel 10 having a wick 15 disposed on its inner surface 28 and with its closed end 24 sealed. End cap 20 is positioned in coaxial aligned relation with open end 22 of vessel 10, such that flange 32 is arranged in confronting relation to shoulder 29. Once in this position, end cap 20 is moved toward vessel 10 so that flange 32 enters open end 22. End cap 20 continues into central passageway 26 until flange 32 engages shoulder 29. Once in this position, flange 32 is sealingly attached to shoulder 29 via solder, brazing, welding, or the like.

With end cap 20 mounted to shoulder 29 within central passageway 26, vessel 10 is partially filled with a working fluid through fill tube 36. Central passageway 26 is then evacuated through fill tube 36. After evacuation, fill tube 36 is pinched closed. At this point in the construction, vessel 10 constitutes an operational heat pipe. However, in order to ensure all the condensable gases are removed, fill tube 36 is quickly opened and shut with the heat pipe at about 100° C. The concave end cap ensures these gases are properly routed to fill tube 36. Fill tube 36 protrudes outwardly from open end 22 in such a way that it detracts from the usability of the device, and is positioned to be damaged during subsequent handling.

Figure 6:
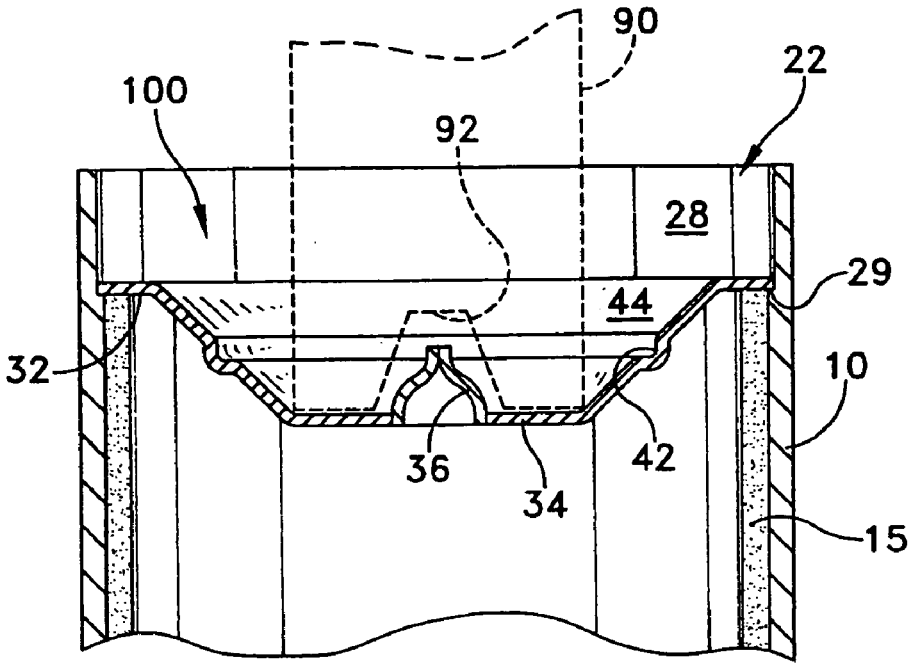
FIG. 6 a cross-sectional view similar to FIG. 5, but after the forming tool has applied a force to the deformable end cap.
Figure 7:
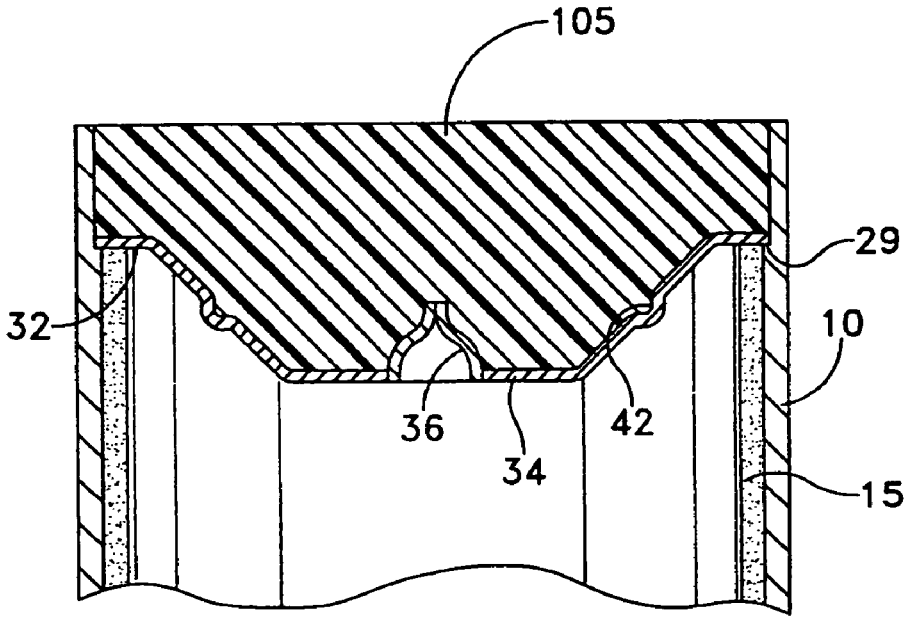
FIG. 7 a cross-sectional view similar to FIG. 6, but after the recess formed by the deformation of the deformable end cap has been filled with a sealant.

Advantageously, end cap 20 may be buckled inwardly, toward central passageway 26, so as to place the remaining portion of fill tube 36 within a shallow recess 100 formed in opened end 22 (FIG. 6). More particularly, a tool 90 comprising a recess portion 92 is positioned in coaxially aligned, confronting relation to face plate 34 of deformable end cap 20. In this position, the remnants of fill tube 36 are disposed in confronting relation to recess portion 92 of tool 90. Tool 90 is then moved toward face plate 34 so as to engage end cap 20. As tool 90 exerts force on face plate 34, annular groove 42 creates a stress concentration in deformable-wall 30 that results in end cap 20 buckling inwardly so that it no longer projects outwardly from open end 22, i.e., convexly, but rather projects inwardly into central passageway 26, i.e., concavely (FIG. 6). In other words, deformable-wall 30 moves from a convex position to a concave position (relative to central passageway 26) upon application of tool 90 to face plate 34. Stress concentrator 42 allows for more reliable and predictable buckling of deformable-wall 30. Once in this concave position, shallow recess 100 in open end 22 of vessel 10 may be filled with an appropriate sealant 105, e.g., epoxy, resin or the like, (FIG. 7). In this way, fill tube 36 is further protected from inadvertent damage which would result in the destruction of heat pipe 5.

It is to be understood that the present invention is by no means limited only to the particular constructions herein disclosed and shown in the drawings, but also comprises any modifications or equivalents within the scope of the claims.

What is claimed is:

1. A heat pipe comprising:

a vessel having a first end, a second end, and an inner surface defining a passageway wherein said first end is closed;

a wick disposed on a portion of said inner surface; and a single convex wall positioned at said second end and blocking said passageway, wherein said convex wall comprises a frusto-conical shape and is deformable so as to move from a first position wherein a portion of said wall is convex to a second position wherein said portion of said wall is concave.

2. A heat pipe according to claim 1 wherein said convex wall comprises a through-bore with a tube sealingly positioned within said through-bore.

3. A heat pipe comprising:

a vessel having a first end, a second end, and an inner surface defining a passageway wherein said first end is closed;

a wick disposed on a portion of said inner surface; and a single convex wall positioned at said second end and blocking said passageway, wherein said convex wall comprises a frusto-conical shape having an annular groove defined on an inner surface and is deformable so as to move from a first position wherein a portion of said wall is convex to a second position wherein said portion of said wall is concave.

4. A heat pipe according to claim 3 wherein said convex wall comprises an annular groove.

5. A heat pipe according to claim 3 wherein said second end of said vessel comprises an annular shoulder onto which a portion of said convex wall is sealingly fixed.

6. A heat pipe according to claim 3 wherein said concave portion of said wall is filled with a sealant.

7. A heat pipe comprising:

a blind tube having a first end, a second end, and an inner surface defining a central passageway;

a wick disposed on at least a portion of said inner surfaces; and a single convex wall positioned at said second end and blocking said central passageway, wherein said convex wall comprises a frusto-conical shape and is deformable so as to change said wall from convex to concave.

8. A heat pipe according to claim 7 wherein said convex wall comprises a through-bore with a second tube sealingly positioned within said through-bore.

9. A heat pipe according to claim 7 wherein said convex wall comprises a stress concentrator formed on a surface.

10. A heat pipe comprising:

a blind tube having a first end, a second end, and an inner surface defining a central passageway;

a wick disposed on at least a portion of said inner surface; and a single convex wall positioned at said second end and blocking said central passageway, wherein said convex wall comprises a frusto-conical shape having an annular groove formed on an inner surface and is deformable so as to change said wall from convex to concave.

11. A heat pipe according to claim 10 wherein said convex wall includes a flange projecting radially outwardly from an edge and said second end of said vessel comprises an annular shoulder onto which said flange is sealingly brazed.

12. A heat pipe according to claim 10 wherein said concave portion of said vessel is filled with a sealant.

* * * * *